United States Patent [19]

Renaud

[11] Patent Number: 5,066,154

[45] Date of Patent: Nov. 19, 1991

[54] PENCIL SUPPORT FOR SECURITY HAT

[76] Inventor: J. Maurice Renaud, 7769 rue Tellier, Montréal, Québec, Canada, H1L 2Z5

[21] Appl. No.: 586,208

[22] Filed: Sep. 21, 1990

[51] Int. Cl.[5] ..... B43K 23/02; A44B 21/00

[52] U.S. Cl. ..... 401/131; 24/11 HC; 24/10 R; 24/3 R

[58] Field of Search ..... 24/11 HC, 11 PP, 11 P, 24/11 R, 3 R, 3 H, 3 J, 3 L, 10 R; 401/131, 6, 48

[56] References Cited

U.S. PATENT DOCUMENTS

| | | | |
|---|---|---|---|
| 1,481,984 | 1/1924 | Carnett | 24/11 PP |
| 1,704,075 | 3/1929 | Brown | 24/10 R |
| 2,345,051 | 3/1944 | Jensen | 24/3 J |
| 3,983,602 | 10/1976 | Barry | 24/11 R |

*Primary Examiner*—Danton D. DeMille

*Attorney, Agent, or Firm*—Swabey Ogilvy Renault

[57] ABSTRACT

Device for fixing a pencil or the like on a security hat of the type comprising a sheath disposed at the base of the hat, constituting a cavity which extends from top to bottom and is open at both ends thereof. The device comprises a generally flat member which is formed of a slight curvature enabling it to rest against the surface of the security hat. A hook is formed from the member enabling to introduce and hold a pencil or an object of the same type. The flat member comprises a tongue intended to be introduced in the cavity by snapping thereby preventing the exit of the tongue once the latter is in position in the cavity.

2 Claims, 1 Drawing Sheet

PENCIL SUPPORT FOR SECURITY HAT

BACKGROUND OF INVENTION (a) Field of the Invention

The invention concerns a pencil holder for security hat. More specifically, the invention is concerned with the device for fixing a pencil or the like object on a security hat of the type comprising a sheath at the base of the hat, the device being fixed in the sheath.

(b) Description of Prior Art

It is known that wearing a security hat on construction sites is mandatory. It is known on the other hand that the use of a pencil or other object of this type when a person is working on a construction site is something which takes place every moment. The pencil must therefore be very easily accessible, and it has been found that the best would be to somewhat fix it on the security hat.

SUMMARY OF INVENTION

The invention concerns a device for fixedly mounting a pencil or the like object on a security hat of the type comprising a sheath disposed at the base of said hat, which sheath constitutes a cavity which extends from top to bottom and is open at both ends thereof, said device being characterized in that it comprises a generally flat member which is formed with a slight curvature enabling it to rest on the surface of the security hat, hook means formed with said member enabling to introduce and hold therein said pencil or the like object of the same type, said flat member comprising a strip intended to be introduced into said cavity, and snapping means preventing the strip from exiting from the sheath by itself once the latter is in position in said sheath.

According to a preferred embodiment, the hook means comprises a first cut made on the flat element, said cut being of reversed U shape to form a tongue, the latter being curved to constitute the hook.

According to another preferred embodiment, the lower end of the strip extends past the lower end of the sheath, and the snapping means comprises a first transverse shoulder relative to the strip, formed on a face of said strip, so as to abut against the lower edge of the sheath.

According to another preferred embodiment of the invention, a projection of vertical triangular cross-section is formed on one face of the strip to contribute to the tightening of the latter in the sheath.

According to another preferred embodiment of the invention, the strip is divided into a central part and two terminal parts, the central part comprising the projection of triangular cross-section and the shoulder, and the two terminal parts each comprises a triangular thickening contributing to further the tightening of the device in the sheath.

According to another preferred embodiment of the invention, the lower end of the strip comprises in its central part a second transversal shoulder enabling the mounting of the device in a longest sheath which does not enable the use of the first shoulder.

BRIEF DESCRIPTION OF DRAWINGS

In the drawings which illustrate the invention.

With reference to the drawings, it will be seen that the device 1 comprises a generally flat member 3 formed of a curvature indicated at 5 enabling it to rest against the surface of a security hat. This member is rectangular as seen and comprises a rectangular strip which can be introduced into a sheath 11, provided on the two sides (not illustrated) of a security hat, this sheath 11, constituting a cavity.

Figure 1:
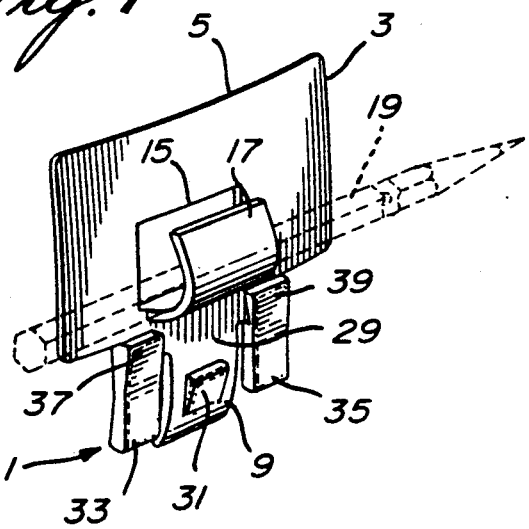
FIG. 1 is a perspective view of a device according to the present invention.
Figure 4:
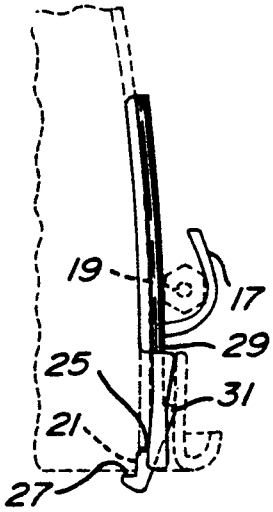
FIG. 4 is a view similar to FIG. 3, the device being inserted in the sheath.
Figure 2:
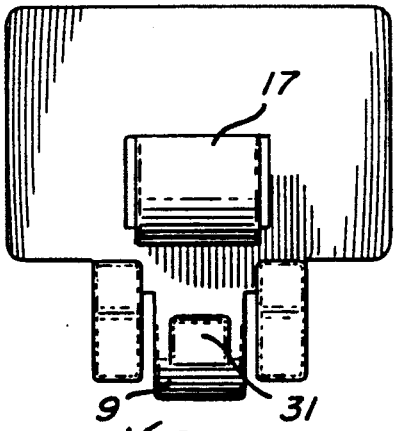
FIG. 2 is a front view of the same device.
Figure 3:
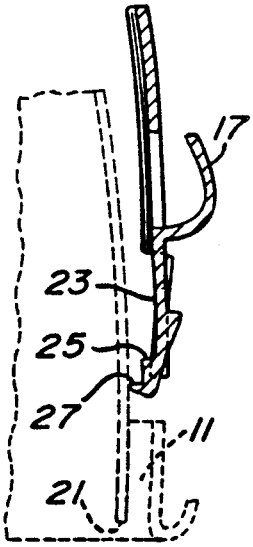
FIG. 3 is a vertical cross-section view of the device previously to inserting same in a sheath.
Figure 5:
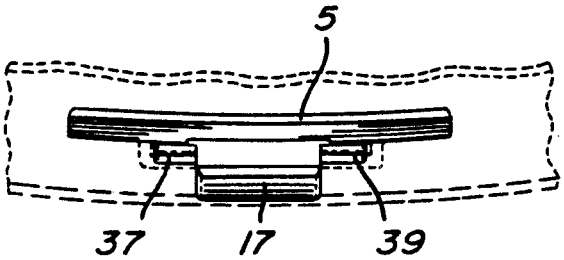
FIG. 5 is a view of the device taken from above.

The rectangular member 3 comprises a reversed U shape cut out 15 forming a curved tongue 17 as indicated in FIG. 1 thus constituting a hook where a pencil 19 can be placed, as illustrated in FIG. 4.

Referring again to the drawings, more particularly to FIG. 4, it will be seen that the lower end of the rectangular strip 9 extends past the lower end 21 of the sheath 11. On the face 23 of the rectangular strip 9 there is a first shoulder 25 which can rest on the lower edge 21 of the sheath 11. Moreover, it will be seen that there is provided a second transversal shoulder 27 enabling to fixedly mount the device in a longer sheath (not illustrated) not enabling the use of the first shoulder 25.

It will also be seen that the face 29 of the central strip 9 comprises a projection 31 with transversal triangular cross-section contributing as seen on FIG. 4 to the tightening of the strip 9 in the sheath 11.

Finally, the device comprises two terminal tongues 33,35, each including a thickening 37,39, contributing to still further tighten the device in the sheath 11.

I claim:

1. Device for fixedly mounting a pencil or other article of the same type on a security hat of the type comprising a sheath disposed at the base of said hat, said sheath constituting a cavity which extends from top to bottom and is opened at both ends thereof, the lower end constituting an edge, wherein said device comprises a generally flat member formed with a slight curvature enabling it to rest on the surface of said security hat, hook means formed with said member, said hook means comprising a reversed U shape cut out formed on said flat member, and shaped to constitute a tongue, said tongue being curved to form a hook, enabling to introduce and hold therein said pencil or said object of the same type, said flat member having a strip intended to be introduced into said cavity, the lower end of said strip extending past the lower end of said sheath, and snapping means preventing the strip from coming out by itself once the latter has been mounted in position in said sheath, said snapping means comprising a first shoulder, which is traversed with respect to said strip, and is formed on a face of the latter so as to rest against the lower edge of the sheath, a projection of vertical triangular cross-section formed on one face of said strip to contribute to the tightening of the strip in said sheath, said strip being divided into a central part and two terminal parts, the central part comprising said projection with triangular cross-section and said shoulder and the two terminal parts each comprising a triangular thickening, these thickenings contributing to tighten said device into said sheath.

2. Device according to claim 1, wherein the lower end of said tongue comprises in its central part a second transversal shoulder, enabling to fixedly mount said device in a longest sheath not enabling the use of the first shoulder.

* * * * *